United States Patent [19]

Hashimoto et al.

[11] 3,977,838

[45] Aug. 31, 1976

[54] ANTI-WEAR FERROUS SINTERED ALLOY

[75] Inventors: Kametaro Hashimoto; Kenji Ushitani; Masashi Shibata; Yasuo Takeda; Yoshitaka Takahashi, all of Toyota, Japan

[73] Assignee: Toyota Jidosha Kogyo Kabushiki Kaisha, Toyota, Japan

[22] Filed: June 11, 1974

[21] Appl. No.: 478,324

[30] Foreign Application Priority Data

June 11, 1973 Japan ..... 48-65579

[52] U.S. Cl. ..... 29/182.5; 29/182; 75/200; 75/202; 75/204; 75/123 B; 75/123 D; 75/123 J

[51] Int. Cl.[2] ..... B22F 3/00; C22C 1/05; C22C 33/02

[58] Field of Search ..... 29/182, 182.1, 182.2, 29/182.5; 75/20 D, 123 D, 123 B, 123 J

[56] References Cited

UNITED STATES PATENTS

| | | | |
|---|---|---|---|
| 2,213,523 | 9/1940 | Jones | 29/182 |
| 3,471,343 | 10/1969 | Koehler | 29/182 |
| 3,713,817 | 1/1973 | Reen | 29/182 |
| 3,753,703 | 8/1973 | Benesousley | 29/182 |
| 3,776,705 | 12/1973 | Niimi | 29/182 |
| 3,793,691 | 2/1974 | Takahashi | 29/182 |
| 3,795,511 | 3/1974 | Niimi | 29/182.2 |
| 3,795,961 | 3/1974 | Takahashi | 29/182 |
| 3,802,852 | 4/1974 | Niimi | 29/182.1 |
| 3,827,863 | 8/1974 | Takahashi | 29/182 |
| 3,856,478 | 12/1974 | Iwata | 29/182 |

*Primary Examiner*—Benjamin R. Padgett
*Assistant Examiner*—Donald P. Walsh
*Attorney, Agent, or Firm*—Brisebois & Kruger

[57] ABSTRACT

The present invention relates to an anti-wear ferrous sintered alloy composed of carbon, molybdenum, phosphorus, boron, and, if desired, copper, and the balance iron.

8 Claims, 4 Drawing Figures

( 400)

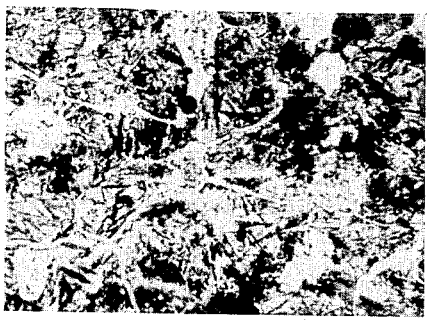
FIG. 1 ( 400)
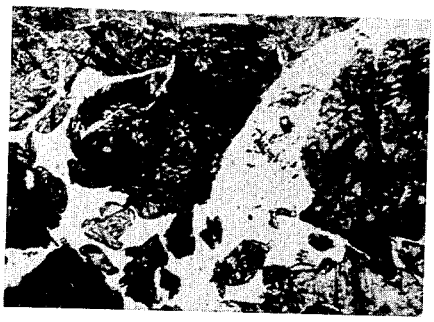
FIG. 2 ( 400)
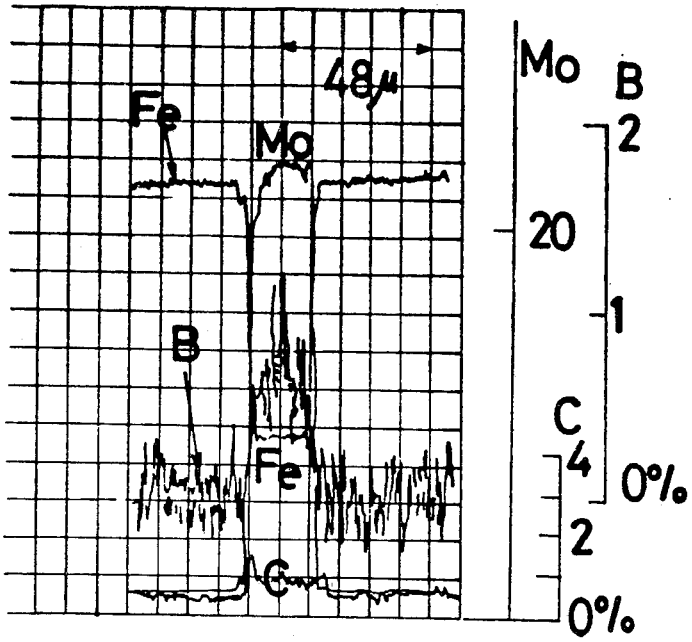
FIG. 3
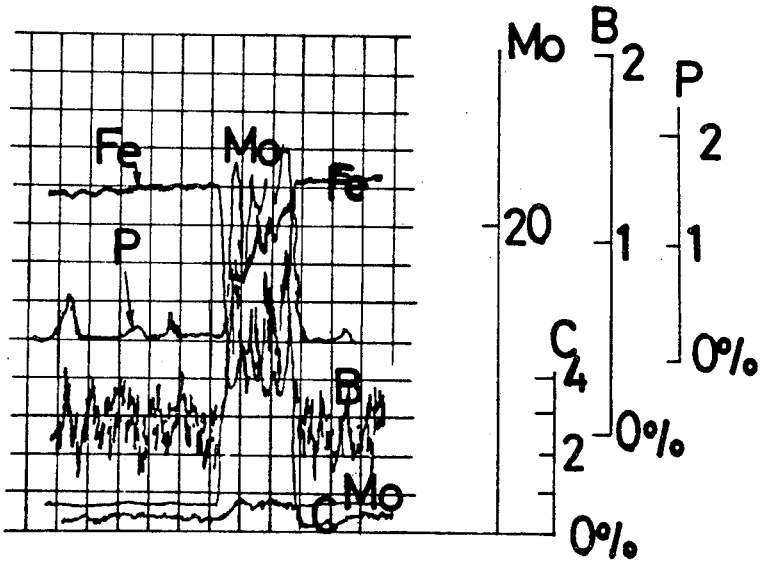
FIG. 4

ANTI-WEAR FERROUS SINTERED ALLOY

BACKGROUND OF THE INVENTION

Use of the conventional anti-heat, anti-wear materials in the internal combustion engine becomes increasingly difficult as the engine becomes smaller and accordingly its load becomes higher.

Especially for valve seat, valve lifter and various seals in the engine using lead-free gasoline, development of materials superior in anti-heat, anti-wear properties is urgently demanded.

Strong materials presently available include sintered alloys of iron and copper, iron and phosphorus, and iron and boron, which are, however, inferior in anti-heat, anti-wear properties and these are found unfit for parts requiring high anti-heat and anti-wear.

High phosphorus cast iron is well-known as an anti-wear material, but being liable to cause blowholes or poor flow of molten metal, the phosphorus content has to be limited to a range of 0.3–0.6%.

Further, there is an improved high phosphorus cast iron, which represents a phosphorus cast iron added with boron, but even this one fails to meet the strength requirements presently demanded of anti-heat, anti-wear materials, because the additions of phosphorus and boron are restricted for technical reasons of casting. Moreover, a cast iron with contents of phosphorus and boron, which develops flaky precipitation of graphite, lacks mechanical strength and is found unfit for service where high strength is required.

SUMMARY OF THE INVENTION

The sintered alloy according to the present invention, is found appropriate as an anti-wear material owing to its superiority to the iron-carbon sintered alloy, common cast iron and cast iron with contents of phosphorus and boron in anti-wear property as well as in mechanical strength.

REFERENCE TO THE DRAWINGS

FIG. 1 is a micrograph of × 400 magnification showing the structure of a sintered alloy in Example I of the present invention.

FIG. 2 is a micrograph of × 400 magnification showing the structure of a sintered alloy in Example II of the present invention.

FIGS. 3 and 4 show the results of X-ray analysis of a sintered alloy in Example I of the present invention.

DETAILED EXPLANATION OF THE INVENTION

The sintered alloy of the present invention, characterized by high strength and high bending strength as well as by anti-heat, anti-wear properties, is an anti-wear ferrous sintered alloy composed of carbon, molybdenum, phosphorus, boron, and if desired, copper, the balance being iron.

According to the present invention, addition of copper improves the strength and anti-wear property of the alloy and gives an increased dimensional accuracy of sintered alloy as compared with one without addition of copper. The composition of the sintered alloy according to the present invention is: carbon 0.5–2.0%, molybdenum 3–18%, phosphorus 0.8–3.0%, boron 0.02–0.3%; and, if desired, copper 0.1–10%, the balance being iron.

Impurity contents in iron such as manganese, silicon or sulfur can be tolerated if the total of these elements is less than about 1% in weight ratio.

Among the elements in the composition of the sintered alloy of the present invention, carbon contributes to the mechanical strength and anti-wear properties of the alloy; it is solid-soluble to iron and molybdenum, thereby strengthening the matrix of the alloy; and it is also solid-soluble to the molybdenum, which precipitates in the matrix, thereby enhancing the anti-wear property.

When the carbon content is less than 0.5%, however, the above effect is low and the desired mechanical strength and anti-wear property cannot be obtained; when the carbon content exceeds 20%, the sintered alloy becomes brittle and unfit for practical use.

Molybdenum is an element contributing to the matrix strength, hardenability and anti-wear property; especially when it is added together with carbon, phosphorus and boron, its effect is excellent because solid-solutions of carbon, phosphorus and boron in the molybdenum precipitates in the matrix contribute remarkably to anti-wear property.

Also molybdenum is effective for improving the hardenability of the alloy. At a cooling rate of 5°–10°C/min in the common sintering furnace, in the absence of molybdenum, the matrix becomes pearlite; but when molybdenum is added, it turns into bainite or martensite. Therefore after passage through the sintering furnace at a relatively slow rate of 5°–10°C/min, the matrix of the alloy attains a Vickers hardness of Hv 400–800.

Molybdenum content, when it is less than 3%, makes no contribution to the anti-wear property; and when it is more than 18%, the alloy becomes brittle with a drop in the mechanical strength.

Phosphorus as well as carbon goes into iron as a solid-solution, forming a ternary eutectic of $\gamma$ -iron, $Fe_3P$ and $Fe_3C$, i.e., the so-called "steadite" and thereby contributing to the anti-wear property; moreover together with boron, molybdenum goes into this steadite as a solid-solution, thereby precipitating a highly wear-resistant network phase with Vickers hardness 1300–1600. When the phosphorus content is less than 0.8%, the steadite precipitate turns out little rendering the alloy inferior in anti-wear property; and when it is more than 3.0%, the alloy becomes brittle with a heavy drop in the mechanical strength.

Boron solid-soluble to steadite improves the anti-wear property of steadite and at the same time, becoming solid-soluble to molybdenum as well, it contributes further to the anti-wear property of the alloy. Meanwhile, phosphorus has the effects of promoting the diffusion of various elements such as carbon, molybdenum; refining the structure, and increasing the mechanical strength of the alloy. When, however, the boron content is less than 0.02%, the above effect is low; and when it is more than 0.3%, the crystals are coarsened, while borides are formed, causing a drop in the mechanical strength.

Addition of copper to an extent of 0.1–10% besides the above elements will have the effect of improving both the mechanical strength and the anti-wear property.

Moreover, addition of copper has the effect of making the dimensional changes in sintering uniform and heightening the precision of a sintered product. However, this effect will be low, if the addition is less than 0.1%; but the addition of more than 10% is undesirable, because it results in a decreased anti-wear property.

A secondary effect of copper addition lies in improvement of the hardness of an alloy after passage through the sintering furnace as compared with that of one with no copper in that, for instance, the Vickers hardness is raised by 150–200 in Examples I and II and thereby improving the anti-wear property.

Specific examples of embodiment of the present invention are given below.

EXAMPLE 1

Carbon as graphite powder of particle size 2–3$\mu$, molybdenum as reducing powder of particle size 5–6$\mu$, and phosphorus and boron as ferro alloys of −200 mesh were added to reducing iron powder of −150 mesh and blended together in a V-type mixer for 30 minutes such that the composition in weight ratio might be carbon 1.2%, molybdenum 12%, phosphorus 1.2%, boron 0.06%, the balance being iron.

Using zinc stearate as the mold lubricator, said powder was molded into a mass of density 6.8 g/cm$^3$, which was then heated to 1130°C in a cracked ammonia gas and sintered for 30 minutes.

EXAMPLE 2

Carbon as graphite powder of particle size 2–3$\mu$, molybdenum as reducing powder of particle size 5–6$\mu$, and phosphorus and boron as ferro alloys of −200 mesh were added to reducing iron powder of −150 mesh such that the composition in weight ratio might be carbon 1.2%, molybdenum 3%, phosphorus 1.2%, boron 0.06%, the balance being iron.

After this, the same treatment as in Example 1 was carried out to obtain a sintered product.

EXAMPLE 3

Carbon as graphite powder of particle size 2–3$\mu$, molybdenum as reducing powder of particle size 5–6$\mu$, and phosphorus and boron as ferro alloys of −200 mesh were added to reducing iron powder of −150 mesh such that the composition in weight ratio might be carbon 1.2%, molybdenum 8%, phosphorus 1.2%, boron 0.06%, the balance being iron. After this, the same treatment as in Example 1 was carried out to obtain a sintered product.

EXAMPLE 4

Carbon as graphite powder of particle size 2–3$\mu$, molybdenum as reducing powder of particle size 5–6$\mu$, and phosphorus and boron as ferro alloys of −200 mesh were added to reducing iron powder of −150 mesh such that the composition in weight ratio might be carbon 1.2%, molybdenum 18%, phosphorus 1.2%, boron 0.06%, the balance being iron.

After this, the same treatment as in Example I was made to obtained a sintered product.

EXAMPLE 5

Carbon as graphite powder of particle size 2–3$\mu$, molybdenum as reducing powder of particle size 5–6$\mu$, and phosphorus and boron as ferro alloys of −200 mesh were added to reducing iron powder of −150 mesh and blended together for 30 minutes in a V-type mixer such that the composition in weight ratio might be carbon 0.5%, molybdenum 12%, phosphorus 2.8%, boron 0.30%, the balance being iron. Using zinc stearate as the mold lubricator, said powder was molded into a mass of 6.9 g/cm$^3$, which was then heated to 1130°C in a cracked ammonia gas and sintered for 30 minutes.

EXAMPLE 6

Carbon as graphite powder of particle size 2–3$\mu$, molybdenum as reducing powder of particle size 5–6$\mu$, and phosphorus and boron as ferro alloys of −200 mesh were added to reducing iron powder of −150 mesh such that the composition in weight ratio might be carbon 1.5%, molybdenum 12%, phosphorus 3.0%, boron 0.20%, the balance being iron. After this, in the same way as in Example 5, a molded mass was obtained and then sintered for 30 minutes by heating up to 1100°C in a cracked ammonia gas.

EXAMPLE 7

Carbon as graphite powder of particle size 2–3$\mu$, molybdenum as reducing powder of particle size 5–6$\mu$, and phosphorus and boron as ferro alloys of −200 mesh were added to reducing iron powder of −150 mesh such that the composition in weight ratio might be carbon 0.2%, molybdenum 12%, phosphorus 0.8%, boron 0.06%, the balance being iron. After this, sintered product was obtained in the same way as in Example 1.

EXAMPLE 8

Carbon as graphite powder of particle size 2–3$\mu$, molybdenum as reducing powder of particle size 5–6$\mu$, and phosphorus and boron as ferro alloys of −200 mesh were added to reducing iron powder of −150 mesh such that the composition in weight ratio might be carbon 0.8%, molybdenum 12%, phosphorus 1.2%, boron 0.02%, the balance being iron. After this, a sintered product was obtained in the same way as in Example 1.

EXAMPLE 9

Carbon as graphite powder of particle size 2–3$\mu$, copper as electrolyte powder of average particle size 20$\mu$, molybdenum as reducing powder of particle size 5–6$\mu$, and phosphorus and boron as ferro alloys of −200 mesh were added to reducing iron powder of −150 mesh such that the composition in weight ratio might be carbon 1.5%, molybdenum 12%, copper 10%, phosphorus 1.2%, boron 0.06%, the balance being iron. After this, a sintered product was obtained in the same way as in Example 5.

EXAMPLE 10

Carbon as graphite powder of particle size 2–3$\mu$, copper as electrolyte powder of average particle size 20$\mu$, and phosphorus and boron as ferro alloys of −200 mesh were added to reducing iron powder of −150 mesh such that the composition in weight ratio might be carbon 1.5%, molybdenum 12%, copper 5%, phosphorus 1.2%, boron 0.06%, the balance being iron. After this, a sintered product was obtained in the same way as in Example 5.

EXAMPLE 11

Carbon as graphite powder of particle size 2–3$\mu$, copper as electrolyte powder of average particle size 20$\mu$, and molybdenum, phosphorus and boron as ferro alloys of −200 mesh were added to reducing iron powder of −150 mesh such that the composition in weight ratio might be carbon 1.2%, molybdenum 12%, copper 1.0%, phosphorus 1.2%, boron 0.06%, the balance being iron. After this, a sintered product was obtained in the same way as in Example 5.

EXAMPLE 12

Carbon as graphite powder of particle size 2–3$\mu$, copper as electrolyte powder of average particle size 20$\mu$, and molybdenum, phosphorus and boron as ferro alloys of −200 mesh were added to reducing iron powder of −150 mesh such that the composition in weight ratio might be carbon 1.2%, molybdenum 9%, copper 0.1%, phosphorus 1.2%, boron 0.06%, the balance being iron. After this, a sintered product was obtained in the same way as in EXAMPLE 5.

Anti-wear ferrous sintered alloys obtained in Examples 1–12 of the present invention were submitted to tests for density, hardness, bending strength and wear.

In the wear test, the sintered alloy of the present invention was pressed against a quenched-and-tempered disk of SCM40 with a pressure of 3 kg/mm$^2$, the slipping velocity being 10 m/sec. under oil lubrication.

Density was measured by the water immersion method. Hardness was measured under 10 kg load using a Vickers hardness meter. For bending strength, a specimen 4 × 8 × 25 mm conforming to JIS was cut out and put to a three-point bending test with a span of 20 mm.

A sintered alloy of iron—0.8%, carbon, a common cast iron FC 30, and a phosphorus-and-boron containing iron were employed as controls. The test results are summarized in Table 1.

Table 1

| | Examples | Composition (%) | Density (g/cm$^3$) | Hardness (Hv) | Bending strength (kg/mm) | wear (mg) |
|---|---|---|---|---|---|---|
| Sintered alloys of present invention | 1 | C1.2%, Mo12%, P1.2% B0.06%, Balance Fe | 7.49 | 560 | 84 | 1.23 |
| | 2 | C1.2%, Mo3%, P1.2% B0.06%, Balance Fe | 7.44 | 442 | 76 | 1.69 |
| | 3 | C1.2%, Mo8%, P1.2% B0.06%, Balance Fe | 7.46 | 551 | 78 | 1.43 |
| | 4 | C1.2%, Mo18%, P1.2% B0.06%, Balance Fe | 7.57 | 537 | 68 | 1.39 |
| | 5 | C0.5%, Mo12%, P2.8% B0.3%, Balance Fe | 7.32 | 413 | 54 | 1.40 |
| | 6 | C1.5%, Mo12%, P3.0% B0.20%, Balance Fe | 7.37 | 675 | 58 | 1.12 |
| | 7 | C2.0%, Mo12%, P0.8% B0.06%, Balance Fe | 7.02 | 420 | 53 | 1.72 |
| | 8 | C0.8%, Mo12%, P1.2% B0.02%, Balance Fe | 7.15 | 454 | 62 | 1.68 |
| | 9 | C1.5%, Mo12%, Cu10% P1.2%, B0.06%, Balance Fe | 7.77 | 496 | 80 | 1.65 |
| | 10 | C1.5%, Mo15%, Cu5% P1.2%, B0.06% Balance Fe | 7.68 | 618 | 84 | 1.38 |
| | 11 | C1.2%, Mo12%, Cu1% P1.2%, B0.06% Balance Fe | 7.59 | 790 | 98 | 1.12 |
| | 12 | C1.2%, Mo9%, Cu0.1% P1.2%, B0.06% Balance Fe | 7.42 | 485 | 76 | 1.67 |
| | Iron-0.8% carbon sintered alloy (density 6.8kg/cm$^3$) | | 6.8 | 140 | 38 | 5.49 |
| | Common cast iron Fe 30 | | 7.2 | 250 | 41 | 5.08 |
| | Phosphorus-boron cast iron: C3.5%, Si2.0%, Mn0.8%, P0.4%, B0.03%, Balance Fe | | 7.2 | 300 | 35 | 3.15 |

As seen from Table 1, the sintered alloys of the present invention are so superior to the controls, i.e., iron-carbon sintered alloy, common cast iron and phosphorus-boron cast iron in anti-wear property and mechanical strength that it is obvious that they can serve as anti-wear materials requiring mechanical strength.

Now referring to micrographs of the sintered alloys of the present invention, FIG. 1 shows a microstructure of the sintered alloy in Example 1, and FIG. 2 that of one in Example 11.

As illustrated in FIG. 1, the matrix is bainite with a Vickers hardness of Hv 400–600.

Meanwhile, the precipitate is a network ternary eutectic structure, called "steadite," of $Fe_3P$, $Fe_3C$ and $\gamma$-iron, with solid solutions of molybdenum and boron, which excels in anti-wear property with a micro-Vickers hardness of 1300–1600; the average value of micro-Vickers hardness of precipitates in FIG. 1 is 1380. Thus, the Vickers hardness of a sintered product obtained right after the sintering ranges from Hv 400 to 800.

FIG. 2 illustrates a microstructure of the sintered alloy in Example 11. The matrix is bainite and the network structure of steadite is more widely developed than in FIG. 1. From this, it may be judged that an improvement of Vickers hardness is obtained by the amounts of 150–200. On the other hand, a finer distribution of voids than in FIG. 1 seems to have contributed to an increase in the hardness.

Next, the results of X-ray analysis on the structure of Example 1 as illustrated in FIG. 1 are given in FIGS. 3 and 4. The X-ray analysis was conducted under the following conditions; accelerating voltage 20KV, specimen current 0.04$\mu$A and electron diameter less than 1$\mu\phi$. In the X-ray analysis shown in FIGS. 3 and 4, the precipitates observed in FIG. 1 were traversed. In the analysis of the results in FIG. 3, iron, carbon, molybdenum and boron were analyzed, and in the analysis of the results in FIG. 4, analysis was made on different spots from those in FIG. 3. The analyses of FIG. 3 and FIG. 4 by X-ray reveal the state of solid solution of molybdenum and boron in steadite and the formation of molybdenum carbide, boride and phosphide in the precipitates.

What is claimed is:

1. Anti-wear ferrous sintered alloy consisting essentially of 0.5–2.0% carbon, 3–18% molybdenum, 0.8–3.0% phosphorus, 0.02–0.3% boron, and 0–10% copper, by weight, with the balance substantially all iron.

2. Anti-wear alloy as claimed in claim 1 in which said alloy comprises a steadite precipitate in a bainite matrix with molybdenum and boron in solid solution in said steadite.

3. Anti-wear alloy as claimed in claim 1 in which said alloy comprises a steadite precipitate in a martensite matrix with molybdenum and boron in solid solution in said steadite.

4. Anti-wear alloy as claimed in claim 1 comprising 0.1–10% copper.

5. Anti-wear alloy as claimed in claim 1 formed from the following powders:

graphite having a particle size of 2–3 microns and providing said carbon, molybdenum powder having a particle size of 5–6 microns, −200 mesh ferro-alloys providing said phosphorus and boron, and −150 mesh iron powder.

6. A valve seat made from the alloy of claim 1.

7. A valve lifter made from the alloy of claim 1.

8. A valve seal made from the alloy of claim 1.

* * * * *